US008879755B2

(12) United States Patent
Maier et al.

(10) Patent No.: US 8,879,755 B2
(45) Date of Patent: Nov. 4, 2014

(54) AT LEAST PARTIALLY IMPLANTABLE SOUND PICK-UP DEVICE WITH ULTRASOUND EMITTER

(75) Inventors: Hannes Maier, Hamburg (CH); Bernd Waldmann, Maur (CH)

(73) Assignee: Advanced Bionics AG, Staefa (CH)

( * ) Notice: Subject to any disclaimer, the term of this patent is extended or adjusted under 35 U.S.C. 154(b) by 0 days.

(21) Appl. No.: 13/979,102

(22) PCT Filed: Jan. 11, 2011

(86) PCT No.: PCT/EP2011/050248

§ 371 (c)(1),
(2), (4) Date: Sep. 5, 2013

(87) PCT Pub. No.: WO2011/042569

PCT Pub. Date: Apr. 14, 2011

(65) Prior Publication Data

US 2013/0343582 A1 Dec. 26, 2013

(51) Int. Cl.
*H04R 25/00* (2006.01)
*H04R 23/00* (2006.01)

(52) U.S. Cl.
CPC ..... *H04R 25/00* (2013.01); *H04R 23/00* (2013.01); *H04R 25/604* (2013.01); *H04R 2225/67* (2013.01)
USPC ..... 381/151; 381/312; 600/25; 607/57

(58) Field of Classification Search
CPC ..... A61N 1/36032
USPC ..... 381/312, 151; 600/25; 607/55, 57
See application file for complete search history.

(56) References Cited

U.S. PATENT DOCUMENTS

| | | | | |
|---|---|---|---|---|
| 6,216,040 | B1 | 4/2001 | Harrison | |
| 6,554,761 | B1 | 4/2003 | Puria et al. | |
| 2004/0101143 | A1 * | 5/2004 | Avalos et al. | 381/2 |
| 2005/0101831 | A1 | 5/2005 | Miller, III et al. | |
| 2007/0161848 | A1 | 7/2007 | Dalton et al. | |
| 2008/0239325 | A1 * | 10/2008 | Cheng et al. | 356/614 |
| 2012/0022376 | A1 * | 1/2012 | Amara et al. | 600/443 |

OTHER PUBLICATIONS

Wikipedia, "Continuous-wave radar", Jul. 8, 2009.*
International Search Report and Written Opinion received in International Application No. PCT/EP2011/050248 dated Sep. 23, 2011.
Konkov, E. "Ultrasonic Interferometer for High-Accuracy Linear Measurements", *Measurement Science Review*, vol. 9, No. 6, pp. 187-188, Jan. 1, 2009.
"Eardrum", *Wikipedia*, http://en.wikipedia.org/w/index.php?title=Eardrum&oldid=390116590, as accessed on Oct. 11, 2010.

* cited by examiner

*Primary Examiner* — Ahmad F Matar
*Assistant Examiner* — Katherine Faley
(74) *Attorney, Agent, or Firm* — ALG Intellectual Property, LLC

(57) ABSTRACT

There is provided an at least partially implantable device for picking up sound impinging onto a skin area of a person, comprising means for generating an audio signal corresponding to the change in time of the distance between a position of the device and the outer surface of the skin area, wherein the device position is adjacent to the skin area.

16 Claims, 2 Drawing Sheets

AT LEAST PARTIALLY IMPLANTABLE SOUND PICK-UP DEVICE WITH ULTRASOUND EMITTER

The invention relates to an at least partially implantable microphone, in particular of a hearing aid.

Fully implantable hearing aids require bio-compatibility of all components due to the need of implanting all components of the device. This applies, in particular, also to the sound input transducer, which usually is a microphone.

Conventional hearing aid microphones are designed to have an acoustic impedance similar to air in order to reduce reflection losses and to obtain high sound sensitivity, low noise and low vibration sensitivity. To provide the possibility for implantation of a microphone into the body two different approaches are known: The first approach is to provide a implanted sensor, such as displacement sensor, a velocity sensor (U.S. Pat. No. 6,636,768), an acceleration sensor (US 2005/0137447 A1), an electric sensor or a hydrostatic sensor (U.S. Pat. No. 6,473,651B1) as a sound pick-up means at the ossicular chain, the tympanic membrane (U.S. Pat. No. 6,554,761 B1) or inside the cochlea (U.S. Pat. No. 5,782,744). The second approach is to build a hermetic microphone suitable for locations under the skin (U.S. Pat. No. 5,859,916, U.S. Pat. No. 6,516,228, U.S. Pat. No. 5,814,095) or the mucosa of the middle ear (U.S. Pat. No. 6,216,040, U.S. Pat. No. 6,636,768). Both approaches are currently used in practice, but involve design-specific problems.

Sound sensors for implantable hearing aids at the ossicular chain or tympanic membrane suffer from the significant drawback that they are acoustically connected to the output (for example, a transducer at the ossicular chain or at the cochlear). In order to avoid output being coupled back into the pick-up means (i.e. to avoid feedback), the ossicular chain has to be interrupted, which may result in a permanent damages for the patient. It is to be noted that the feedback issue is not relevant to hearing aids having a non-mechanical actuator, such as cochlear implants.

Subdermal microphones are mostly derived from conventional designs and have a bio-compatible housing with an inert microphone membrane (U.S. Pat. No. 6,422,991 B1, U.S. Pat. No. 6,093,144, U.S. Pat. No. 6,626,822 B1). Piezo- and electrodynamic mechanical transduction principles and, more rarely, mechano-optical conversion (US 2007/0161848 A1), have been suggested. In any case, the acoustic reflective losses of about 55 dB at the air/tissue interface and the mass loading on the microphone membrane by the overlying skin have to be compensated for. Even in applications with minimal skin thickness, for example, when placing the microphone in the outer ear canal wall (U.S. Pat. No. 6,516,228, U.S. Pat. No. 6,381,336, U.S. Pat. No. 5,814,095), the mass loading by skin is by several magnitudes higher than for conventional microphone membranes when used for sound pick-up in air. Due to the lower sensitivity caused by significant reflections, implanted microphones must have larger integration surfaces (WO 2005/046513 A2) and larger size in order to lower the noise level (WO 02/49394 A1, WO 2007/008259 A2). In some applications, corresponding closed volumes are used to increase the amplitude at the implanted microphone (U.S. Pat. No. 6,736,771). In addition, the mass loading of the overlying skin will be subject to normal biological changes like temperature-induced thickness changes, blood flow and muscular activity.

On the other hand, the skin is suspended by the microphone membrane from below, and accelerations of the body will lead to significant artificial amplitudes in the audio signals produced by the implanted microphone; this effect is taken into account by some designs (US 2006/0155346 A1, US 2005/0197524 A1). It has been proposed to use soft tissue placement with a movable microphone position in order to provide for less acceleration-induced relative movements between the skin surface and the microphone membrane, compared to fixation at a bone (WO 2007/001989 A2).

It is an object of the invention to provide for an at least partially implantable sound pick-up device which has only little sensitivity to body acceleration and which is small and easy to implant. It is a further object to provide for an at least partially implantable hearing aid comprising such implantable sound pick-up device. It is a further object to provide for a corresponding sound pick-up method.

According to the invention, these objects are achieved by a sound pick-up device as defined in claim 1, a hearing aid as defined in claim 16 and a sound pick-up method as defined in claim 18, respectively.

The present invention is beneficial in that, by generating an audio signal corresponding to the change in time of the distance between the position of the device and the outer surface of a skin area adjacent to the device position the need of a subcutaneous microphone membrane is eliminated, whereby the impact of body acceleration on the audio signal and the size of the device can be reduced; also, the lower size makes implantation easier.

Preferred embodiments of the invention are defined in the dependent claims.

Hereinafter examples of the invention will be illustrated by reference to the attached drawings, wherein.

According to the invention, sound impinging onto a skin area of a patient is picked-up by generating an audio signal corresponding to the change in time of the distance between a position of the device and the outer surface of the skin area, wherein the device position is adjacent to the skin area.

According to one embodiment, an ultrasound signal is emitted towards the outer surface of the skin area from an ultrasound emitter fixed to a bone or in soft tissue, and an ultrasound signal reflected at the outer surface of the skin area is received by an ultrasound sensor fixed to a bone or in soft tissue. Preferably, the audio signal is generated as an output signal which is proportional to the velocity of the outer surface of the skin area, as detected by analyzing the reflected ultrasound signal. This principle is schematically shown in FIGS. 1 and 2.

Figure 1:
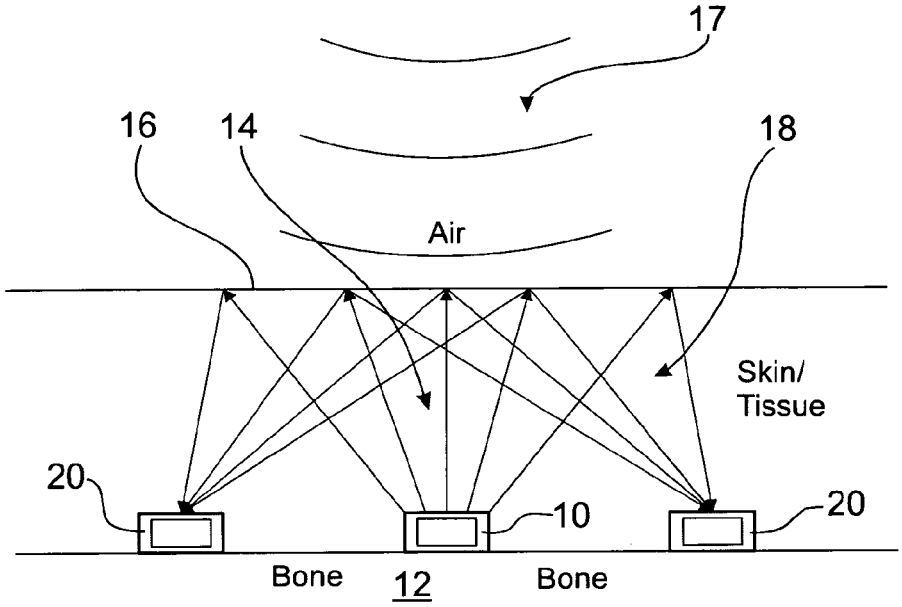
FIG. 1 shows schematically how sound impinging onto a skin area may be picked-up by implanted ultrasound emitters and receivers.

According to FIG. 1, an ultrasound emitter 10 which is fixed on an underlying bone 12 or in soft tissue emits a frequency modulated or constant frequency sine wave 14 towards the skin surface 16 which is impressed by outer audible sound waves 17 in the air and thus acts as a low-compliant microphone membrane to modulate and reflect the incident ultrasound wave 14. The reflected and thereby modulated ultrasound wave 18 is received by ultrasound sensors 20 which are likewise fixed on the underlying bone 12 or in soft tissue. The velocity of the reflecting skin surface 16 can be extracted by using an interferometer or a heterodyne interferometer method, as will be explained in more detail by reference to FIGS. 2 and 3, respectively. The device 22 of FIG. 2 serves to measure the sound-evoked velocity of the skin surface 16 by ultrasound reflection using a interferometer principle, thereby avoiding the need for a subcutaneous microphone membrane. When sound impinges on the skin, most of the intensity is reflected at the surface due to the pronounced impedance difference between air and tissue. Due to the specific impedance for tissue and the specific impedance of air, the loss in sound transmission is approximately 55 dB, and the sound reflection for perpendicular incidence is almost 100%. The amount of reflection only depends on the impedance difference and is independent of the direction. Hence, ultrasound from the tissue side is reflected with high efficiency to the interior at the skin surface.

The external sound impinging on the skin surface causes an indention of the skin, which is a relatively small effect requiring an adequate measurement technique. The skin velocity resulting from hearing aid relevant sound pressure levels can be estimated, for example, to be about 1 μm/s for a sound pressure level of 100 dB and to be 0.1 nm/s for a sound pressure level of 20 dB. The detector uses the fact that the Doppler frequency shift for a stationary emitter and a moving reflector having a velocity $v$ is proportional to the surface velocity. More precisely, Doppler frequency shift is given by $\Delta f=2v/2\lambda_0$, where $\lambda_0$ is the wavelength. Consequently, the resolution increases with increasing sound frequencies (corresponding to decreasing wavelengths).

Figure 2:
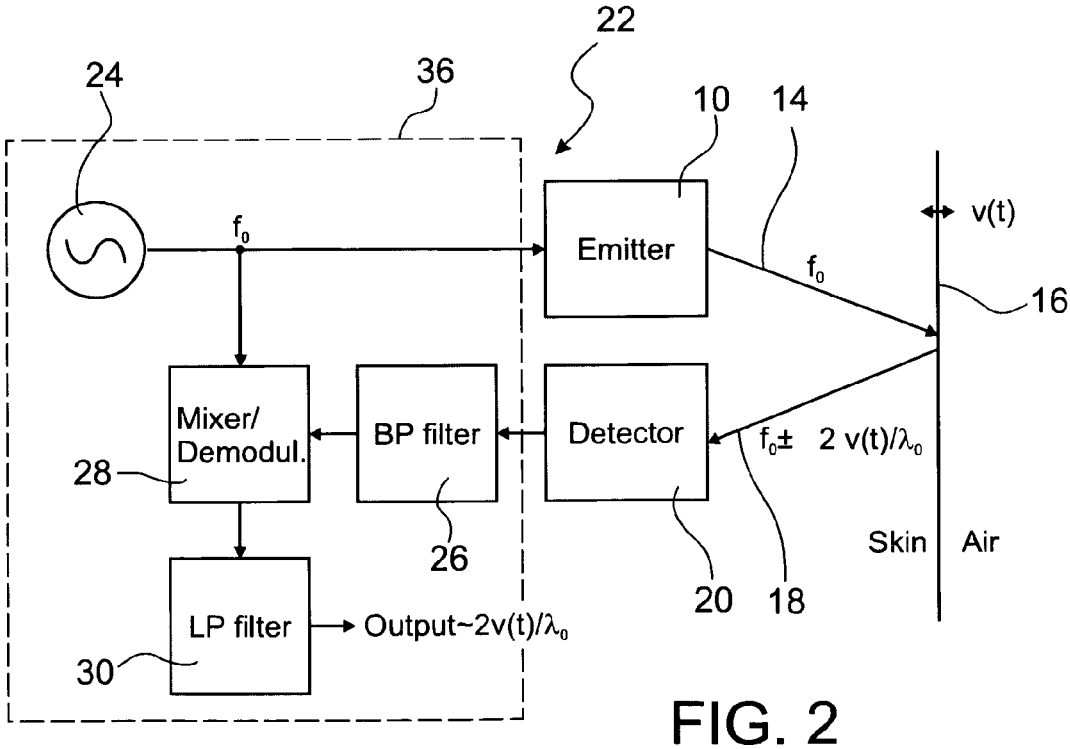
FIG. 2 is block diagram of an example of a interferometer ultrasound device for picking up sound impinging onto a skin area.

The device 22 of FIG. 2 comprises a signal generator 24 which drives an ultrasound emitter 10 in such a manner that it emits ultrasound waves at a constant carrier frequency $f_0$. The ultrasound wave 14 is reflected at the skin surface 16 which moves at a velocity v. The reflected ultrasound wave 18 has a frequency which is modulated by the vibration velocity of the skin surface 16 by $2v(t)/\lambda_0$. The modulated ultrasound wave 18 is detected by an ultrasound sensor 20. The output signal of the sensor 20 undergoes band pass filtering in a band pass 26 and thereafter is demodulated in a mixer/demodulator 28 which is fed by the signal generator 24 with the demodulator reference. The output signal of the mixer/demodulator 28 undergoes low pass filtering in a low pass 30. The elements 24, 26, 28 and 30 form an audio signal unit 36 which creates an output signal which is proportional to the actual skin velocity v and hence can be used as a microphone signal for audio signal processing in a hearing aid. The required modulation band width can be estimated as $4f_{skin}$ where $f_{skin}$ is the vibration frequency of the skin surface 16. Various demodulation techniques can be used, such as analogue demodulation, phase locked loop (PLL) demodulation and digital demodulation utilizing digital signal processing (DSP) techniques. Velocity resolutions and noise may be optimized sufficiently in order to obtain relative resolutions far below the ultrasound wavelength by integration.

For example, an ultrasound frequency $f_0$ of 40 MHz and a travel distance of 2 cm from the emitter 10 to the skin surface 16 back to the receiver 20 can be assumed. Assuming a sound velocity in tissue as 1,600 m/s leads to a wavelength $\lambda_0$=40 μm. Assuming the damping coefficient as $\alpha_{skin}$=0.5 leads to an attenuation of 40 dB at the receiver site. This damping also restricts the vibration sensitive skin area to a reasonable size and reduces reflection effects from other sites in the head (preferably, the sound pick-up device 22 will be located in the patient's head). Damping of the reflected ultrasound wave 18 by transmission to the air side is negligible.

Increasing the carrier frequency will result in better resolution and advantages for filtering, while the amplitude of the reflected wave 18 will decrease. It depends on the specific geometry and skin thickness whether such trade-off in reflective amplitude is tolerable. Increasing the carrier frequency also will allow reducing the size of the transducers 10, 20, whereby implantation is facilitated. Probably the size could be reduced to such an extent that minimal invasive implantation, for example, by syringe needle application, is enabled. Such reduced size devices may allow realizing arrays for directed emission and taped delay lines for directional hearing.

Preferably, the carrier frequency $f_0$ is between 10 MHz and 100 MHz to increase resolution and reduce crosstalk between multiple implanted microphones of the mentioned type.

Figure 3:
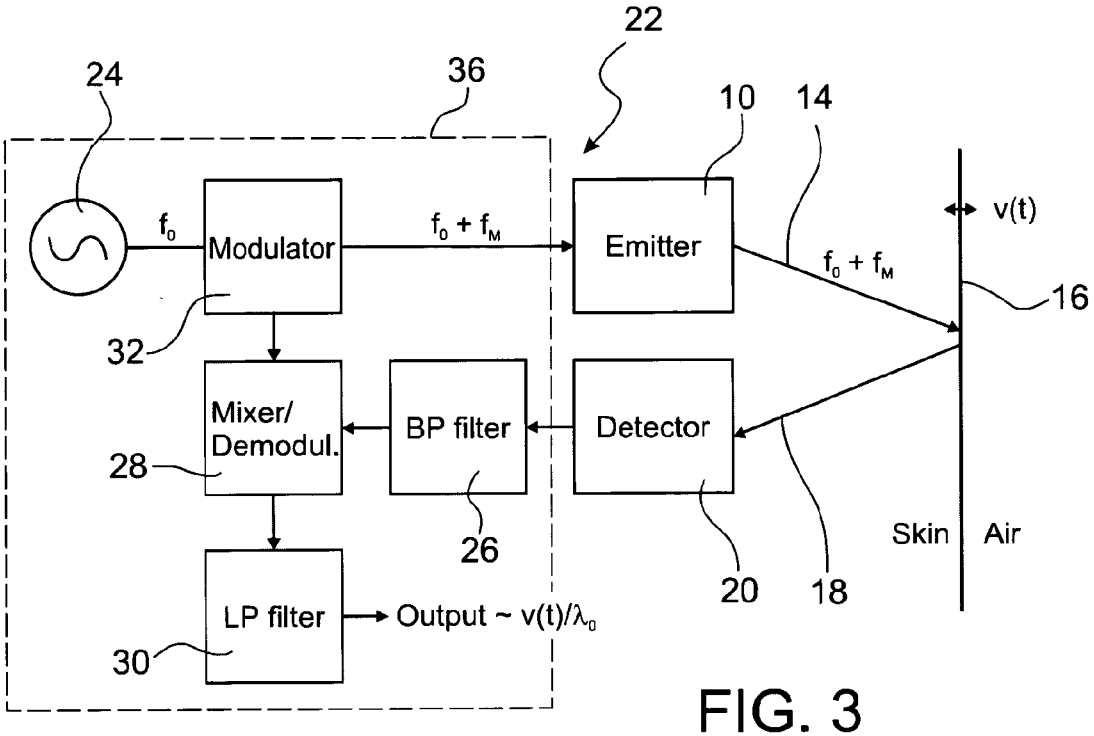
FIG. 3 is block diagram of an example of a heterodyne interferometer ultrasound device for picking up sound impinging onto a skin area.

In FIG. 3 an alternative embodiment is shown which uses a heterodyne interferometer method for extracting the skin velocity. While in the interferometer method in FIG. 2 ultrasound waves of constant frequency are emitted, in the embodiment of FIG. 3 the constant frequency carrier signal generated by the signal generator 24 is frequency modulated by a modulator 32 at a modulation frequency $f_M$, which modulated signal is supplied to the ultrasound emitted 10 in order to emit frequency modulated ultrasound waves rather than constant frequency ultrasound waves. Accordingly, the demodulator 28 is supplied with the signal of the modulator 32 (rather than with the signal of the signal generator 24) as the demodulation reference. In the embodiment of FIG. 3 the required modulation band width can be estimated as $2(f_M+2f_{skin})$ where $f_{skin}$ and $f_M$ are the vibration frequency of the skin surface 16 and the modulation frequency.

Preferably, the band pass filter 26 blocks frequencies differing from the carrier frequency $f_0$ by more than $4f_{skin}$ (for the interferometer principle of FIG. 2) or $2(f_M+2f_{skin})$ (for the heterodyne principle of FIG. 3).

Figure 4:
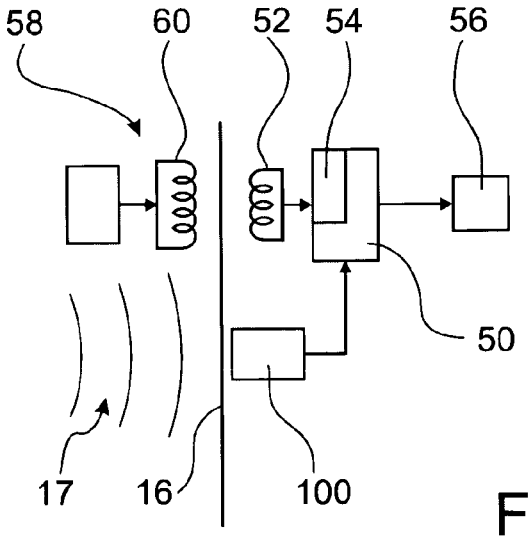
FIG. 4 is a schematic block diagram of an example of a fully implantable hearing aid using an implantable sound pick-up device according to the invention.

FIG. 4 is a schematic block diagram of an example of a fully implantable hearing aid using an implantable sound pick-up device 100 according to the invention. The hearing aid comprises an implantable sound pick-up device 100, an implantable audio signal processing unit 50, an implantable power receiving coil 52, an implantable power management unit 54 including a rechargeable battery, and an implantable actuator 56. The audio signals picked up by the implantable sound pick-up device 100 are supplied to the audio signal processing unit 50 which converts the audio signals into a signal for driving the actuator 56 which stimulates the patient's hearing according to the sound picked up by the implantable sound pick-up device 100. The actuator 56 may be, for example, a cochlear electrode or an electromechanical transducer acting on the ossicular chain or directly on the cochlea.

The power receiving coil 52 receives power from an external charging device 58 comprising a power transmission coil 60 via an inductive transcutaneous power link (typically, the external charging device 58 may be worn at night to recharge the implantable battery of the power management unit 54).

The invention claimed is:

1. An at least partially implantable device for picking up sound impinging onto a skin area of a person, comprising:

an ultrasound emitter fixed to a bone within the person or in soft tissue within the person and that emits an ultrasound signal towards a surface of the skin area;

at least one ultrasound sensor fixed to the bone or to the soft tissue and that receives a reflected ultrasound signal, the reflected ultrasound signal comprising the ultrasound signal reflected at the surface of the skin area; and an audio signal unit that generates, based on the reflected ultrasound signal, an output signal proportional to a velocity of the surface of the skin area caused by the sound impinging onto the skin area.

2. The device of claim 1, wherein the device as an interferometer and wherein the ultrasound signal emitted by the ultrasound emitter is of a constant frequency.

3. The device of claim 1, further comprising a signal generator that generates an input signal that causes the ultrasound emitter to emit the ultrasound signal, wherein the ultrasound signal has a constant frequency between 10 MHz and 100 MHz.

4. The device of claim 1, further comprising a demodulator that demodulates the reflected ultrasound signal received by the at least one ultrasound sensor.

5. The device of claim 4, further comprising a band-pass filter that band-pass filters an output signal of the at least one ultrasound sensor prior to the output signal of the at least one ultrasound sensor being supplied to the demodulator.

6. The device of claim 5, wherein the band-pass filter blocks frequencies differing from a carrier frequency by more than 80 kHz.

7. The device of claim 5, wherein the band-pass filter blocks frequencies differing from a carrier frequency by more than a modulation frequency plus 80 kHz.

8. The device of claim 4, further comprising a low-pass filter that low-pass filters an output signal of the demodulator.

9. The device of claim 1, wherein the device acts as a heterodyne interferometer and wherein a frequency of the ultrasound signal emitted by the ultrasound emitter is modulated.

10. The device of claim 1, further comprising:

a signal generator that generates a signal at a constant carrier frequency; and a modulator that receives the signal and that generates, based on the signal, a frequency modulated signal that is supplied as an input signal to the ultrasound emitter.

11. The device of claim 10, wherein the carrier frequency is between 10 MHz and 100 MHz.

12. The device of claim 1, wherein the device is fully implantable.

13. An at least partially implantable hearing aid comprising:

an ultrasound emitter fixed to a bone within a person or in soft tissue within the person and that emits an ultrasound signal towards a surface of a skin area of the person;

at least one ultrasound sensor fixed to the bone or to the soft tissue and that receives a reflected ultrasound signal, the reflected ultrasound signal comprising the ultrasound signal reflected at the surface of the skin area;

an audio signal unit that generates, based on the reflected ultrasound signal, an output signal proportional to a velocity of the surface of the skin area caused by sound impinging onto the skin area;

an audio signal processing unit that receives the output signal as an audio input signal and processes the audio input signal; and an implantable output transducer that stimulates the person's hearing according to the processed audio input signal.

14. The hearing aid of claim 13, wherein the hearing aid is fully implantable.

15. A method of picking up sound impinging onto a skin area of a person, the method comprising:

emitting, by an at least partially implantable device fixed to a bone within the person or in soft tissue within the person, an ultrasound signal towards a surface of the skin area;

receiving, by the at least partially implantable device, a reflected ultrasound signal, the reflected ultrasound signal comprising the ultrasound signal reflected at the surface of the skin area; and generating, by the at least partially implantable device based on the reflected ultrasound signal, an output signal proportional to a velocity of the surface of the skin area caused by the sound impinging onto the skin area.

16. The method of claim 15, wherein a position of the at least partially implantable device is at a head of the person.

* * * * *